United States Patent [19]

Baccianti

[11] Patent Number: 4,573,959

[45] Date of Patent: Mar. 4, 1986

[54] FABRIC FOLDING MACHINE

[75] Inventor: Renato Baccianti, Calenzano, Italy

[73] Assignee: Automa s.r.l. Costruzione Macchine Automatiche, Italy

[21] Appl. No.: 457,032

[22] Filed: Jan. 10, 1983

[51] Int. Cl.[4] ..... B31B 1/26; B65H 45/00; A41H 15/00

[52] U.S. Cl. ..... 493/458; 223/37; 493/23; 493/418

[58] Field of Search ..... 493/418, 458, 450, 476, 493/405, 408, 23; 223/37, 38

[56] References Cited

U.S. PATENT DOCUMENTS

| | | | |
|---|---|---|---|
| 2,165,786 | 7/1939 | Christman | 493/418 |
| 2,754,113 | 7/1956 | Sjostrom | 493/418 |
| 3,829,081 | 8/1974 | Gerstenberger | 493/418 |
| 4,060,227 | 11/1977 | Landgraf | 493/418 |
| 4,277,005 | 7/1981 | Heap | 223/37 |

*Primary Examiner*—Leonidas Vlachos
*Assistant Examiner*—Jerry Kearns
*Attorney, Agent, or Firm*—McGlew and Tuttle

[57] ABSTRACT

A fabric folding machine includes a conveyor belt on which the fabric is held and its motion controlled by suction. A pair of lateral blades are hinged about an axis parallel to a fabric feed direction for creating longitudinal folds. Transverse folds are produced by comb-like blades hinged perpendicular to the fabric feed direction. Two sets of comb-like blades are provided which are movable in opposite senses.

One of the two sets of comb-like blades can assume two or more positions. The lateral blades can also be adjusted in terms of their distance apart, orthogonal to the fabric feed direction.

9 Claims, 13 Drawing Figures fB
33
11
317A
34
33
109
13
49
51A
215
11
36
35
47
43
13
41
45
39
fB
203
37
41E
3

XI
33
219
11
320
11
219
16
33
27
27
520
526
528
526
519
522
203
72
74
57
203
3
67
57A
69
63
58
61
XI

FABRIC FOLDING MACHINE

BACKGROUND OF THE INVENTION

1. Technical Field

The present invention relates to fabric folding machines which are particularly suitable for folding rectangular pieces of fabric of small dimensions, for example pillowcases, hand towels, bidet towels and table napkins. The machine is adapted to fold the fabric twice in the longitudinal direction and twice in the transverse direction, i.e. in the so-called "French" manner.

2. Prior Art

Present-day machines carry out "French" folding without it being possible to rapidly change the fabric format or relative position of the folds.

A prior art machine, which receives the fabric from an ironer, substantially comprises: a structure with slide surfaces for the fabric; multiple-belt conveying means for feeding, halting and further feeding the fabric; suction apertures in said structure for retaining the fabric during the folding operations; two longitudinal blades hinged to the outside of said suction assembly parallel to the fabric feed direction in order to effect the longitudinal folding of the fabric; and, within said suction structure, comb-like blades hinged perpendicularly to the fabric feed direction and turnable in opposite directions in order to effect the transverse folding by acting in the interspaces between the conveyor belts. The machine also comprises means for sequentially operating said blades and halting and positioning means for the extended fabric to be folded. In this machine one comb-like blade is provided adjacent to the fabric inlet, as well as two suitably positioned blades, which are more distant from the inlet and are hinged along two spaced-apart axes, the one or the other being operated according to the format of the fabric to be folded and the method of folding. The longitudinal blades are at a fixed distance apart.

SUMMARY OF THE INVENTION

The present invention provides a machine for folding fabric including a structure with a slide surface for the fabric, a multiple-belt conveyor for feeding, halting and further feeding the fabric in a fabric feed direction, suction apertures in said slide surface structure for retaining the fabric during folding operations, two longitudinal blades hinged to the outside of said structure parallel to said fabric feed direction in order to effect longitudinal folding of the fabric, and two comblike blades mounted within said structure by hinges having axes perpendicular to said fabric feed direction within said structure and turnable in opposite directions in order to effect transverse folding by acting in the interspaces between the conveyor belts, the improvement consisting in that at least one of said two comb-like blades is mounted in a displaceable manner such that it can assume at least two positions along the machine, according to the length of the fabric to be folded, and in that respective displaceable suction means are provided to act along the hinges of said comb-like blades, and in that adjustable halting and positioning means are provided for the fabric.

DESCRIPTION OF THE PREFERRED EMBODIMENTS

The fabric folding machine illustrated is intended to be installed downstream of an ironer, or in any manner such as to receive ironed fabric to be folded.

Figure 1:
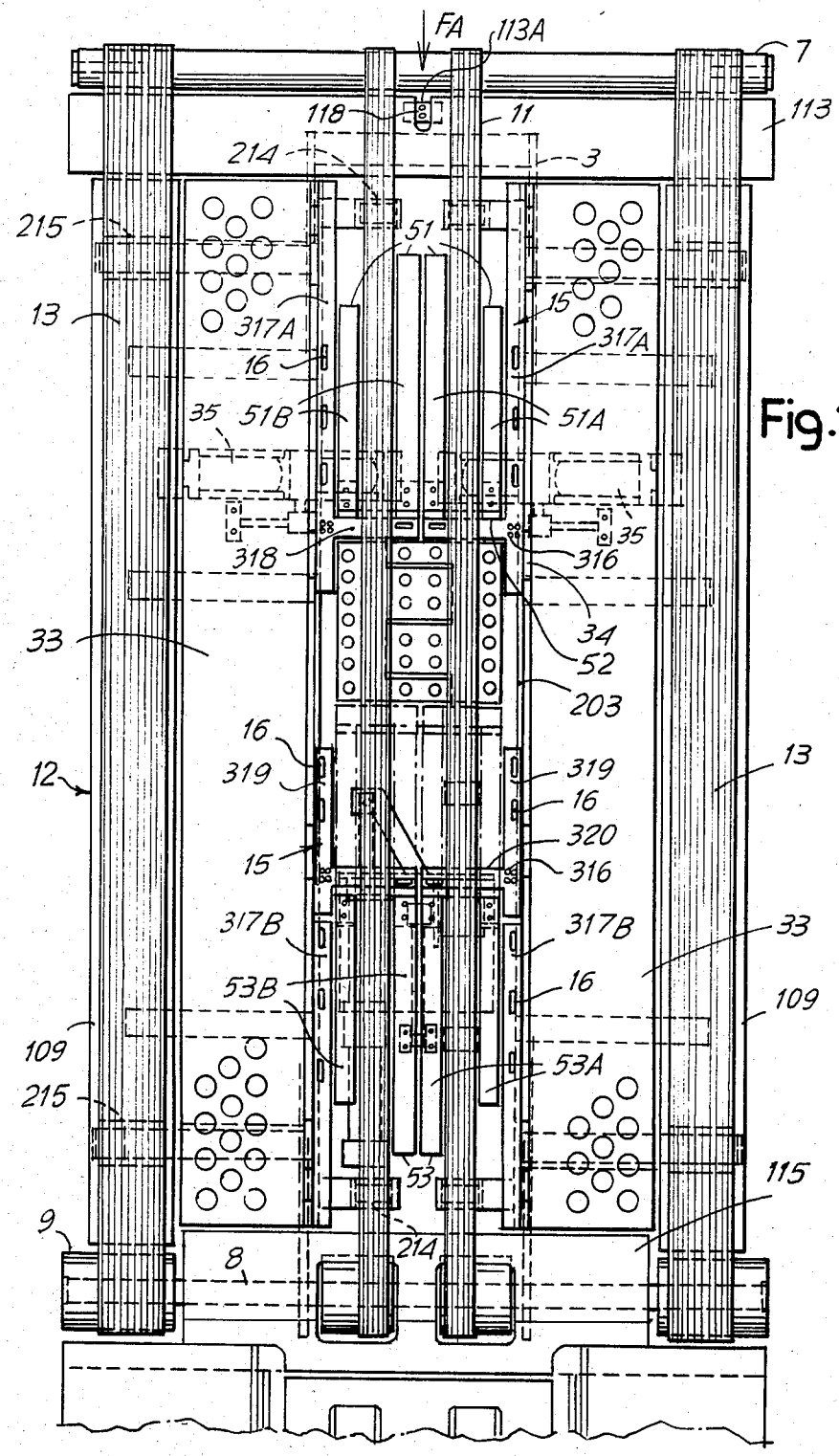
FIGS. 1 and 2 are two partly sectional plan views of the machine in two positions.
Figure 2:
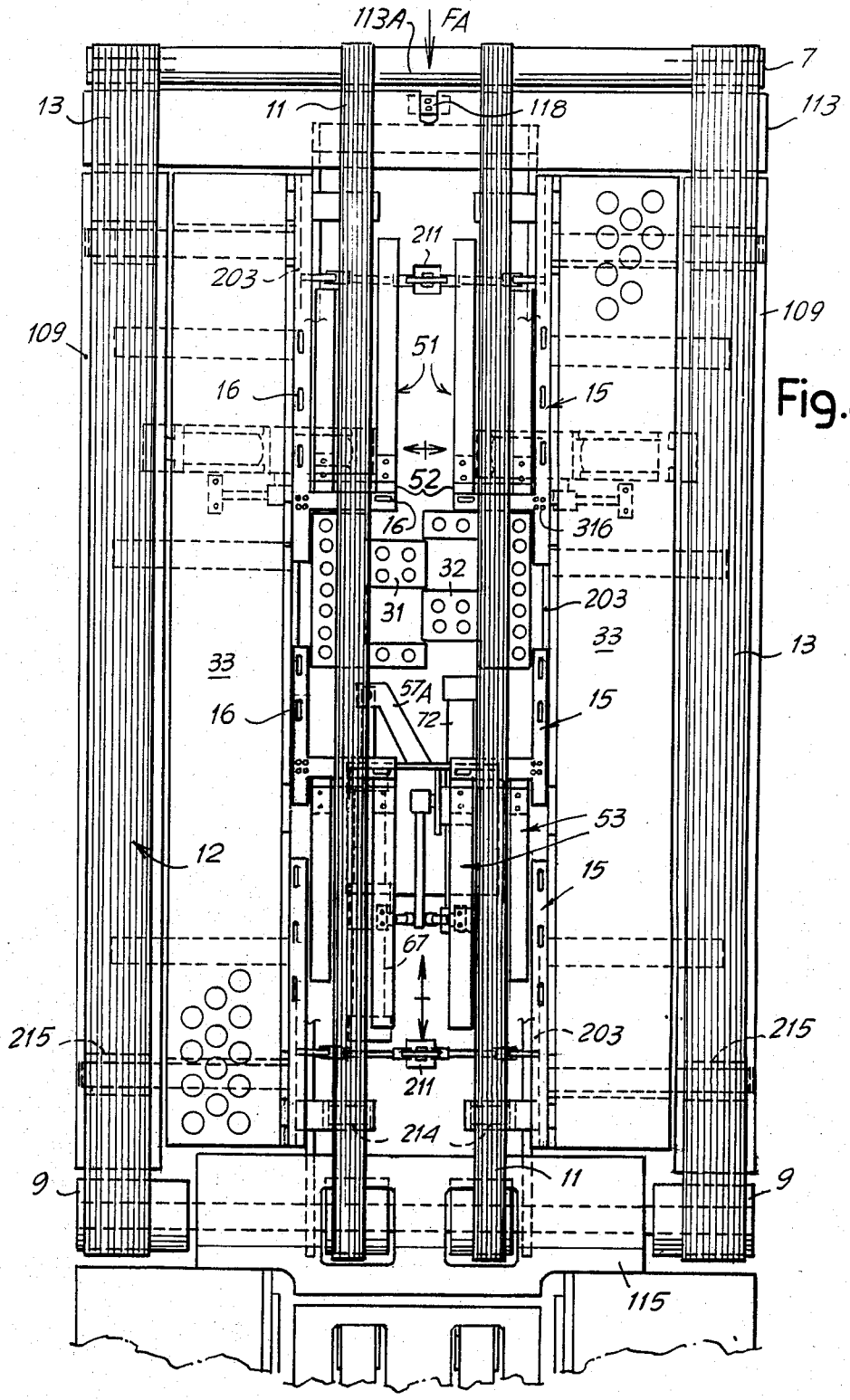
Figure 3:
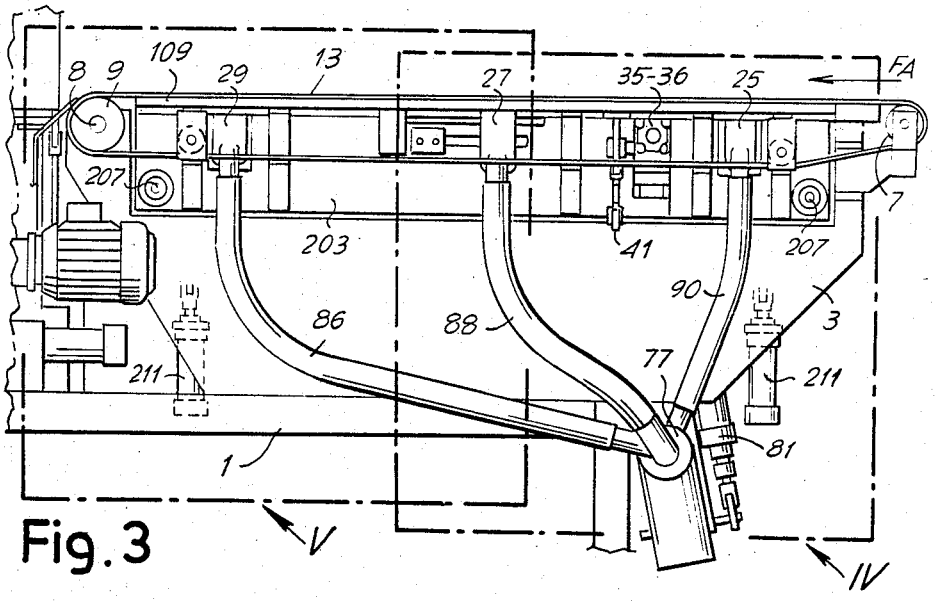
FIG. 3 is an overall longitudinal external view of the machine.
Figure 4:
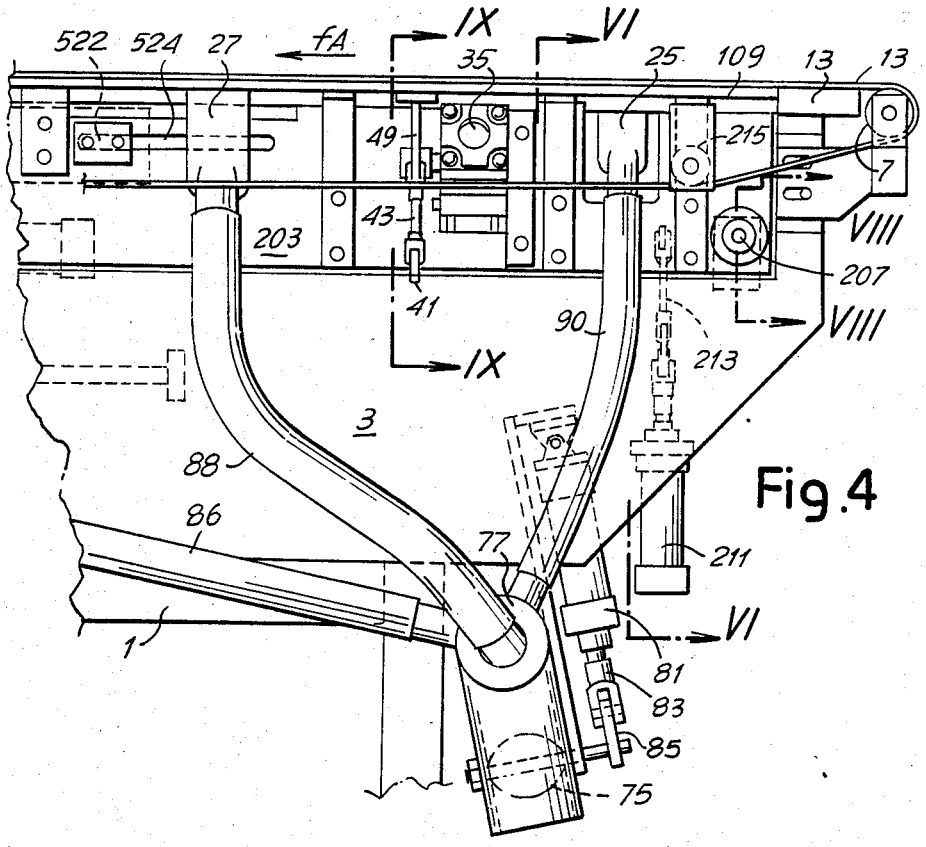
FIGS. 4 and 5 are details of FIG. 3, indicated by the arrows IV and V, to an enlarged scale.

The fixed main structure of the machine as shown in FIG. 3, comprises a base 1 and two longitudinal vertical walls 3, which at their ledge-shaped ends support a roller 7 and a shaft 8 with rollers 9 (also see FIGS. 1, 2 and 4). Two central belts 11 with an adhesive velvet covering and two analogous side belts 13 pass around said rollers as shown in FIGS. 1 and 2. A conveyor 12 is thus formed, arranged to transfer the fabric along the upper surface of the machine in the direction FA from the ironer mounted upstream of the machine.

Figure 6:
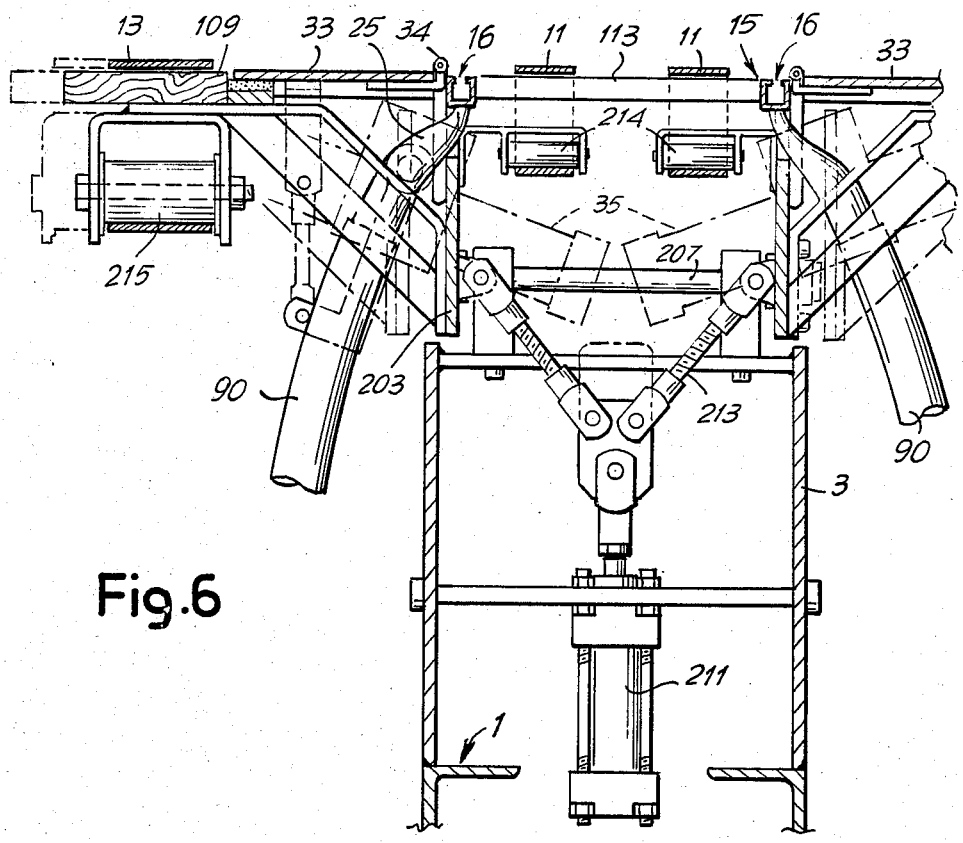
FIG. 6 is a cross-section on the line VI—VI of FIG. 4.
Figure 8:
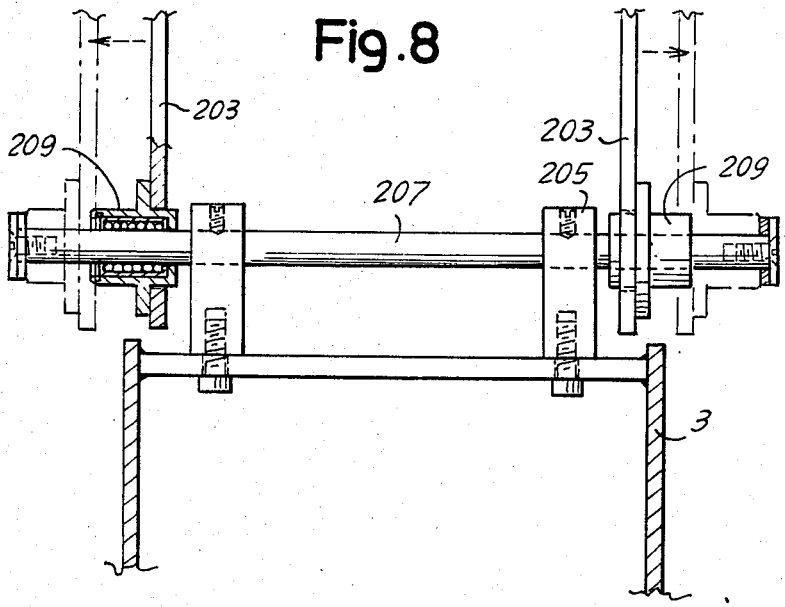
FIG. 8 is a detailed cross-section through a guide for the mobile longitudinal side wall portions.

The longitudinal vertical side walls 3 each comprise, as shown in FIGS. 3, 4, 6 and 8, a transversely mobile portion 203. For this purpose, the walls 3 carry, on supports 205, two transverse guide bars 207 along with slide bushes 209 carried by said side wall portions 203 (FIG. 8). The side wall portions 203 can be moved simultaneously by two cylinder-piston systems 211 (FIG. 6) which act on pairs of diverging connecting rods 213 arranged to thrust and pull the side wall portions 203 in order to cause them to withdraw from and approach each other. The side wall portions 203 carry belt guide means 214 and 215 as shown in FIGS. 2 and 6, which are able to move the belts along the rollers 7 and 9 in such a manner that the belts 11 and 13 follow the lateral movements of the side wall portions (while still staying or rollers 7 and 9).

Figure 5:
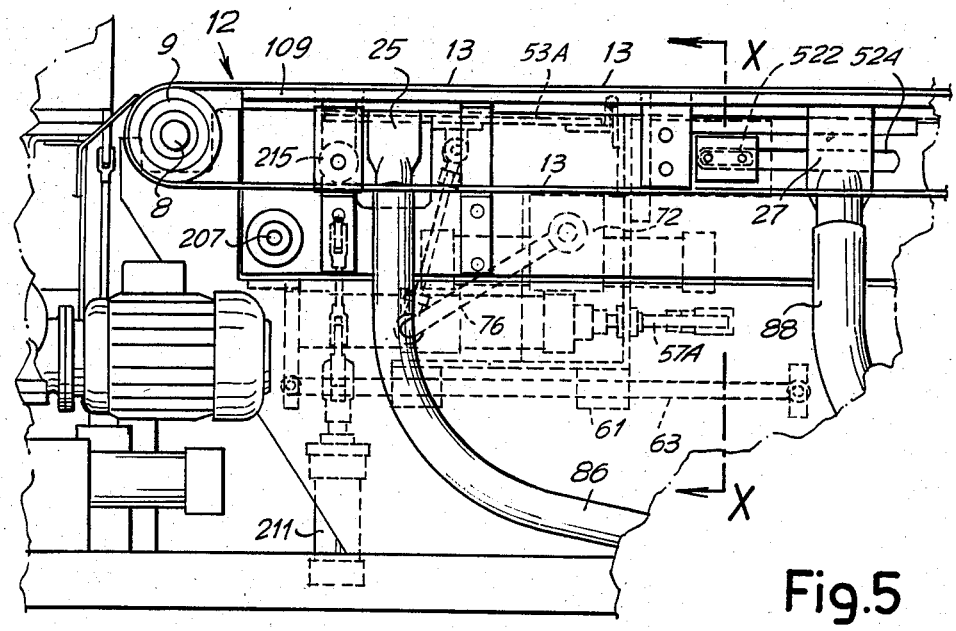
Figure 12:
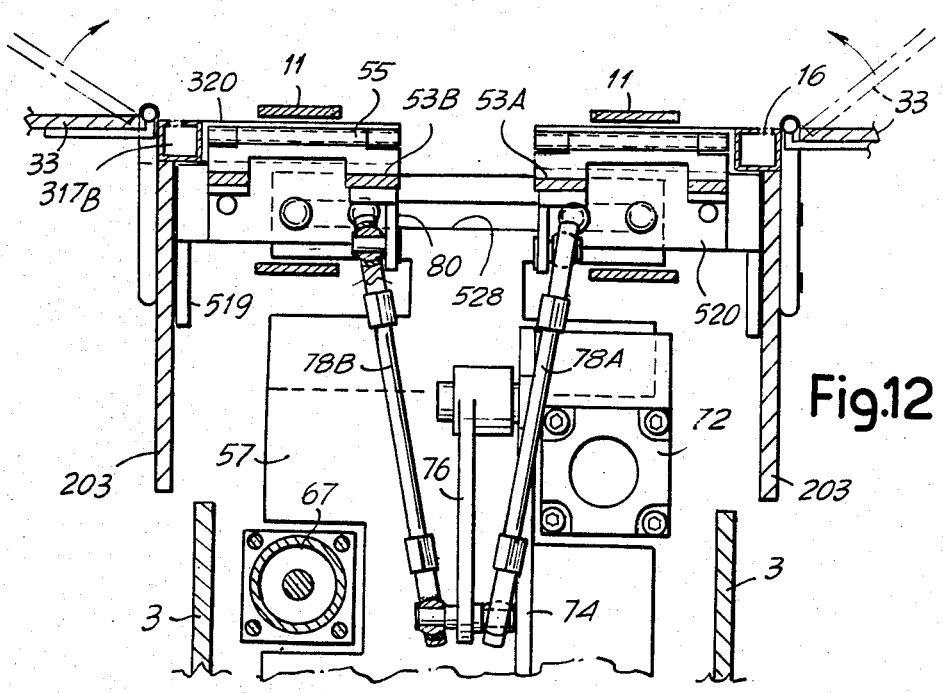
FIG. 12 is a cross-section on the line XII—XII of FIG. 11.
Figure 13:
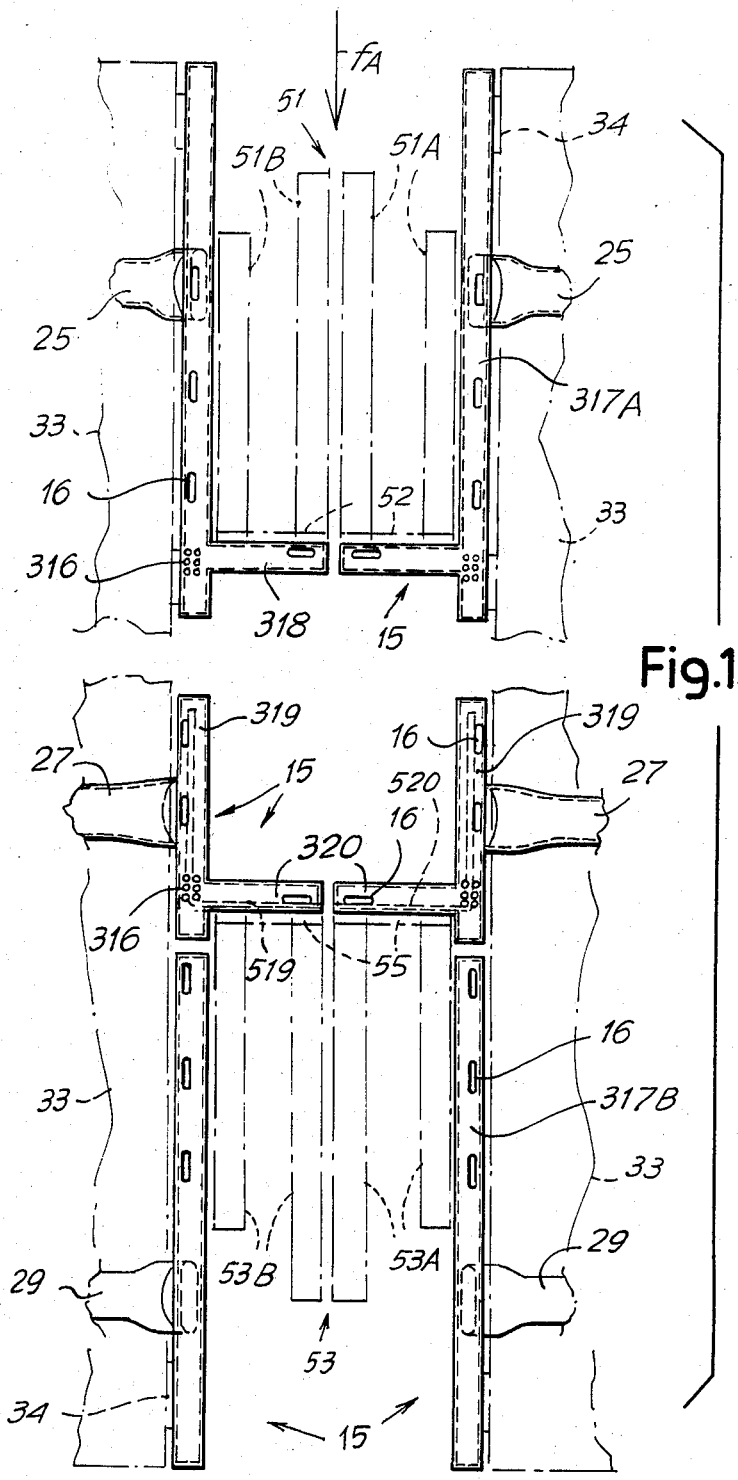
FIG. 13 shows details of a suction assembly.

On the upper edge of the side wall portions 203 (FIGS. 2 and 6) there is welded a suction assembly 15 in a number of parts, including parts fixed to the side wall portions 203 and longitudinally movable parts. Said assembly 15 comprises tube elements of square cross-section with suction slots and perforations in their upper part. More specifically, the assembly 15 comprises: longitudinal tube portions 317A and 317B (FIGS. 1, 9, 11, 12 and 13) fixed to the side wall portions 203 and spaced apart from each other; transverse tube pieces 318 connected to the two portions 317A (FIG. 13); longitudinal tube portions 319 (FIG. 13) which slide along the side wall portions 203 in the space between the corresponding portions 317A and 317B; and transverse tube pieces 320 connected between the two portions 319 (FIGS. 1 and 13). In order to retain, during the folding operation, the fabric on the upper machine surface defined by said tube assembly 15, this tube assembly 15 is provided with slots 16 (FIGS. 1, 6, 12 and 13 and, at its corners, denser perforations 316 (FIGS. 1 and 13) for suction purposes, and below the various parts of said tube assembly there are provided suction ports 25, 27 and 29 (FIGS. 3, 4 and 5) connected to flexible hoses for suction purposes. The central space between the tubes 319 (FIGS. 1 and 13) is partly covered by two cover plates 31,32 (FIG. 2) shaped in such a manner that one intersects the other, so that they can withdraw from and approach each other to follow the respective side wall portions 203. The plates 31 and 32 form a slide surface, and other slide surfaces 113 and 115 are provided at the ends (FIGS. 1 and 2).

Figure 9:
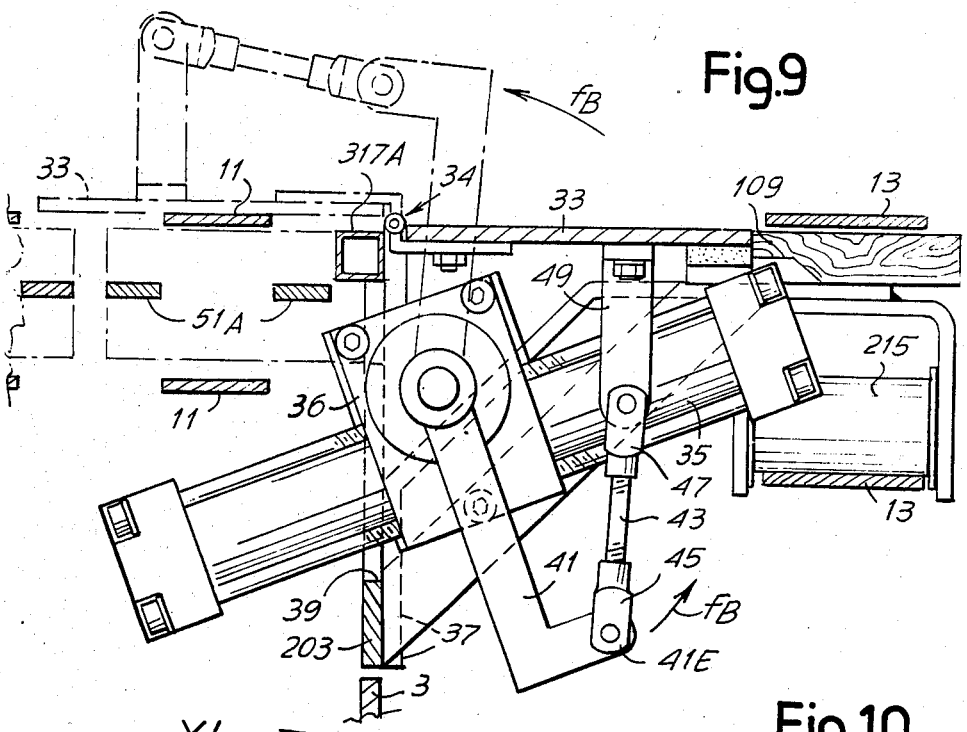
FIG. 9 is a detailed cross-section on the line IX—IX of FIG. 4, to an enlarged scale, to illustrate a control system for the longitudinal blades.
Figure 10:
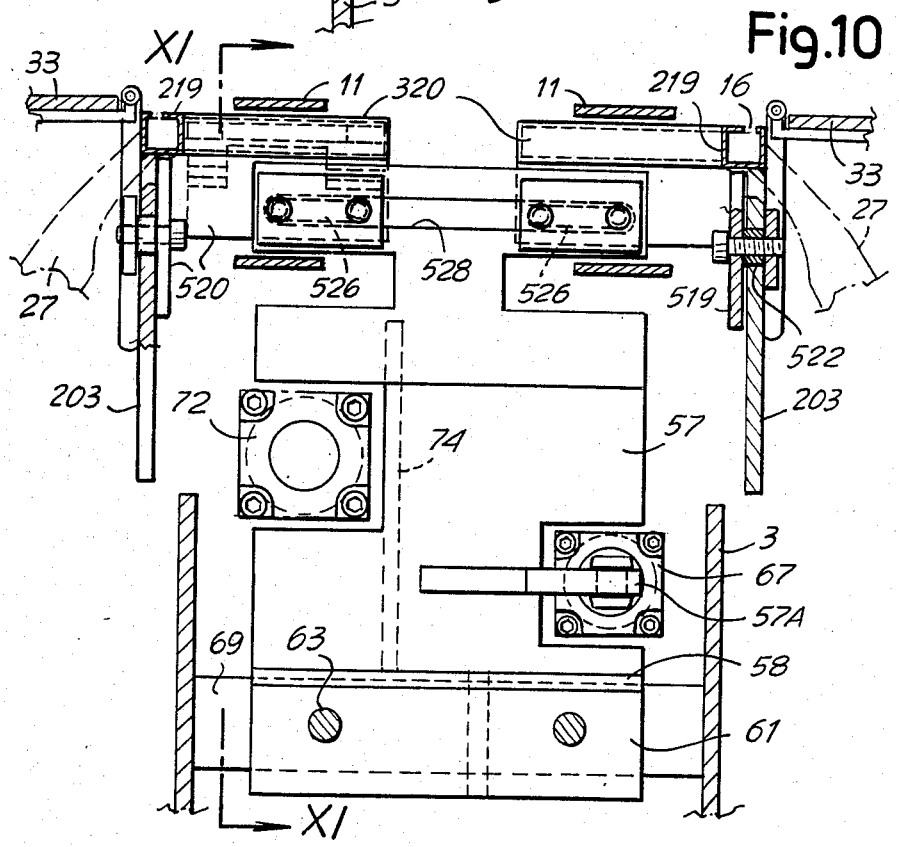
FIG. 10 is a cross-section on the line X—X of FIG. 5, to an enlarged scale.

On the side wall portions 203, along the upper edges and along the portions 317A, 319 and 317B (FIG. 1) of the suction tubes, there are longitudinally hinged at 34 two turnable longitudinal blades 33 arranged to make the two folds in the fabric in the longitudinal direction (FIGS. 1 and 6). These blades 33 follow the side wall portions 203 in their transverse movements. As best shown in FIG. 9, in order to cause the blades 33 to turn over through 180° about the hinges 34, there is provided on each side wall portion 203 at least one control device in the form of a rotary pneumatic cylinder-piston system 35, 36, which is fixed to the side wall portion 203 by means of a support plate 37. In its turn, the side wall portion 203 comprises a slot through which the cylinder of the system 35 extends towards the interior of the machine. The rotation, in the direction of the arrow $f_B$ of an L-shaped arm 41 of the system 35,36 is transmitted to the respective blade 33 by means of a rod 43, of which the forks 45 and 47 are hinged respectively to the end 41E of the arm 41 and to the lower end of a bracket 49 fixed below the blade 33. FIG. 9 shows, with dashed lines, the position of a blade 33 and the relative control mechanism when the overturning movement has been completed. The two opposing blades 33 are operated in succession.

The transverse folds in the fabric are made by two blades 51 and 53 shown in FIGS. 1 and 2, which are of comb-shape so that they can turn over through 180° without interfering with the central belts 11. Each blade is formed from two parts which follow the two side wall portions 203 and the belts 11. The two parts 51A and 51B of the comb-shaped blade 51 are hinged at 52 along the pieces 318 of the suction assembly 15, and the position of their transverse turning axis—defined by the hinges 52—is fixed relative to the longitudinal extension of the machine. In contrast, the two parts 53A and 53B of the blade 53 are hinged by hinges 55 along the pieces 320 also shown in FIG. 11, and are mobile longitudinally with the respective tube portions 319 and the relative pieces 320, which are mobile longitudinally.

Figure 11:
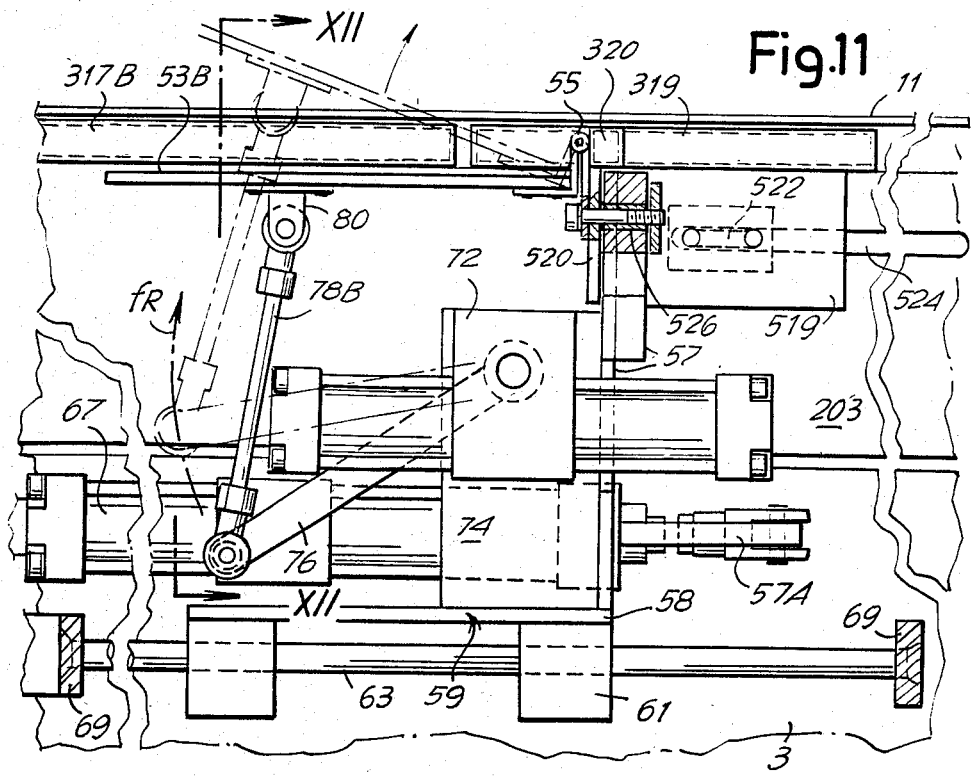
FIG. 11 is a detailed view in longitudinal section on the line XI—XI of FIG. 10.

In order to enable the two tube portions 319 and the relative pieces 320—and the two parts 53A and 53B—to be moved and guided relative to the respective side wall portions 203, each assembly 319,320,55 (to which a respective comb-shaped blade portion 53A or 53B is hinged) is rigid with two rectangular projecting plates 519 and 520, disposed orthogonally to each other. This is best shown in FIGS. 11 and 12. The projecting plate 519 is slidable along the respective side wall portion 203 by means of a slide block 522 which slides in a longitudinal slot 526 in the side wall portions 203. The projecting plate 520 is slidably guided by means of a slide block 526 along a transverse slot 528 in a transverse upright 57. The upright 57 forms part of a longitudinally slidable carriage 59 which can be moved in order to assume two or more different positions.

The carriage 59 (FIG. 11) comprises the vertical upright 57 and a plate 58, which lowerly comprises slide blocks 61 which can slide along guide rods 63 carried by the structure 1,3. A bracket 57A of the upright 57 has fixed to it the head of the rod of a double acting cylinder-piston system 67 (FIGS. 11 and 12), of which the cylinder is rigid with the machine structure 1,3, by being fixed to one of the two cross members 69 which also carry the guides 63. In FIG. 11 the rod 65 of the cylinder-piston system 67 is completely retracted, and the carriage 59 is positioned towards the left. In this situation, the blade 53 is at the maximum distance from the blade 51 (of which the hinge 52 is fixed) allowed by sliding the carriage 59 by means of the system 67. By moving the carriage 59, the blade 53 can be made to assume the most suitable position for making the transverse folds at the required distance. The carriage 59 can assume either one of only two positions or more than two positions, either by means of a system 67 constructed for the purpose, or by using a number of cylinder-piston systems operating in series and/or in parallel, in such a manner as to obtain a number of adjustable positions for the transverse fold made by the blade 53 relative to that made by the blade 51, depending on the dimensions of the fabric to be folded. The positioning can also be carried out in other ways and with more adjustments, including by hand.

When the carriage 59 is moved, its upright 57 causes the projecting plates 520 slidably mounted thereon to also move in the same manner, together with the hinges 55 of the two parts 53A and 53B of the blade 53, and the suction tube portions 319 with the respective tube piece 320. These latter members are also dragged in a direction transverse to the side wall portions 203 on which they are mounted and guided in a longitudinally slidable manner.

In order to turn the blade 53 over through 180° in the direction of the arrow fR, there is provided a rotary cylinder-piston system 72, of which the support plate 74 is fixed to the carriage 59. When caused to rotate by the system 72 in the direction of the arrow fR, the arm 76 of the system 72 induces this overturning movement by means of a pair of thrust rods 78A and 78B which are hinged lowerly to the arm 76 and upperly to brackets 80 fixed below the respective parts 53A and 53B of the blade 53. The two rods 78A and 78B move away from and towards each other with a limited relative inclination to follow the movements of the side wall portion 203, and are able to control the parts 53A and 53B of the blade 53 in all situations.

An arrangement equivalent to the arrangement 72, 76, 78A, 78B, 80 is provided on the structure 1,3 for controlling the two parts 51A and 51B of the comb-shaped blade 51. This arrangement is not mounted on the carriage, as the hinge 52 of the blade 51 is in a fixed position as shown in FIGS. 1 and 2.

Referring now to FIGS. 1 and 2, the extended fabric to be folded is fed in the direction of the arrow FA, and is conveyed by the belts 11 and 13 along the machine. The belts are halted at the required time when the fabric article to be folded is in a predetermined position. At this point, the fabric has to be retained in position on the tubes 317A,317B,319,318,320 by suction through the slots 16 and perforations 316. As these tubes can be moved, the suction within them is obtained by means of flexible suction hoses. The air suction through the slots 16 and perforations 316 keeps the fabric adhering to the machine surface, and occurs only during the folding stages. This effect is accentuated by means of the perforations 316, due to the considerable number and cross-section of these latter. Prior and subsequent to this stage, the air suction is kept shut-off by a butterfly valve 75 disposed in a multi-outlet manifold 77 (see also FIG. 4). The valve 75 is made to close and open by means of a double-acting cylinder-piston system 81. The shut-off member of the valve 75 is rotated by means of the rod 83 of the system 81, which is hinged to an arm 85 fixed to the rotation spindle of said shut-off member. The air sucked through the slots 16 and perforations 316 is conveyed to the manifold 77 by flexible hoses such as the hoses 86,88,90. The manifold 77 is connected in its turn to a buffer vessel and to a suction fan, not shown on the drawing.

In order to fold the fabric, the two longitudinal blades 33 are firstly turned over one after the other, by which two folds are obtained approximately along the hinges 34. The first blade is made to return into its own initial position before the other acts.

After making the longitudinal folds, one of the two combshaped blades 51 and 53 is operated, for example and in particular the blade 51, in order to make the first of the transverse folds. After said comb-shaped blade has returned to its initial position, the other of said blades is operated to make the last fold.

The distance of the blades from their hinge axes depends on the average thickness of the fabric pieces to be folded, and the sequence in which the various blades are operated, and also on the number of thicknesses of fabric present each time a fold is made.

The side wall portions 203 and the carriage 59 (FIG. 11) are displaced in the described manner according to the required distance between the longitudinal and transverse folds. The position at which the arriving extended fabric is halted must also be adjusted in the manner indicated herein.

It should be noted that the perforations 316 provide an accentuated retention effect by virtue of the suction through them. Selective control of the suction in the various portions of suction tube can also be provided, but in practice it is not necessary to carry out selective suction, and in fact it is possible to provide simultaneous suction through all the slots of the various tube portions 317A, 319, 317B, while always ensuring retention even when the blades 51 and 53 are turned over to uncover the outer slots at the hinges 52 and 55 by virtue of the raising of the respective parts of the fabric article being folded by the comb-shaped blades 51 and 53.

The raising operation under the action of the parts 51A, 51B and 53A,53B (even when spaced apart) of the blades 51 and 53 is regular because the spacing is always limited, and the operation is simultaneous for the two parts of the blade. The conveying by the belts 11 and 13 (FIG. 1) is also regular, due to the fact that they are spaced apart in relation to the width of the extended fabric arriving.

On termination of folding, the suction is shut off and the conveyor 12 formed by the belts 11 and 13 is immediately started again. Said conveyor is controlled by a self-braking motor and reduction gear which drives the shaft 8. The conveyor transfers the already folded fabric to the stacking machine, and positions a fresh piece of ironed fabric on the machine surface ready for the subsequent folding operation.

Plates 109 (FIG. 1) are provided below the lateral belts 13 of the conveyor 12, and are fixed to the side wall portions 203, in order to prevent the lateral belts 13 from sagging.

The plate 113 located at the inlet end of the machine comprises a longitudinal slot 113A, along the underneath of which there can be moved into the required position an electronic device 118 of the photoelectric cell, microswitch, proximity switch or other type, for providing a signal as the initial edge, final edge or both said edges of a piece of arriving fabric pass by. By using a processor for these signals, the conveyor 12 is made to halt in such a manner as to obtain the transverse folds in the required position by means of the comb-shaped blades 51 and 53. The positioning of the piece of fabric in the transverse direction is determined by its position as it enters the machine.

After the piece of fabric has been halted, the programmer activates the suction through the slots, followed by the rotation of the blades 33 and the two comb-shaped blades 51 and 53. On termination of the folding cycle, the suction ceases and the conveyor 12 is operated in order to remove the folded piece of fabric, and to feed a further piece of fabric to be folded.

Figure 7:
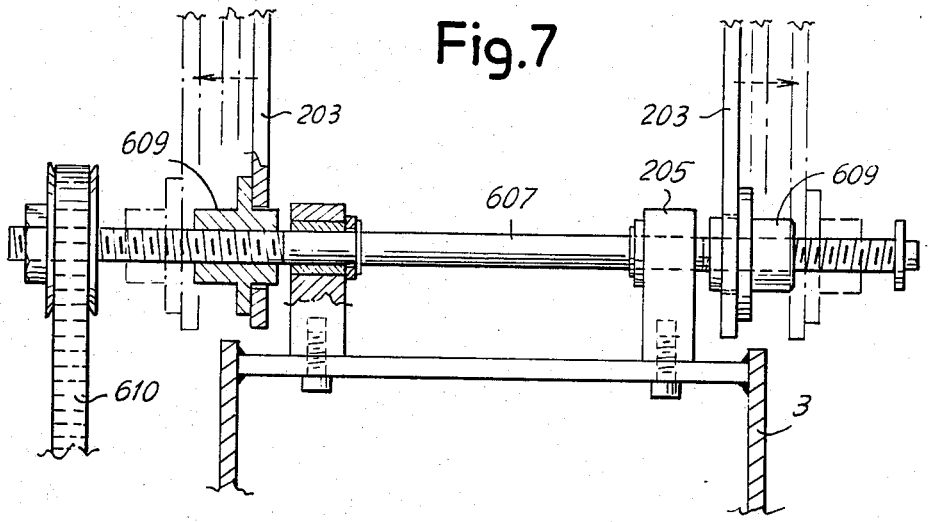
FIG. 7 is a modified embodiment of FIG. 6.

FIG. 7 shows a modification of the operating system for the mobile side wall portions 203. In this modified embodiment, guides 607 similar to the guides 207 are threaded in opposite directions along the portions external to the supports 205, and are rotatably mounted in said support. The guides 607 are controlled simultaneously by a toothed belt drive 610 or other means. Bushes 609 carried by the side wall portions comprise threaded bores for engagement with the threads of the guides 607, the rotation of the guides 607 thus causing the side wall portions 203 to move symmetrically.

It will be appreciated that the above described machine enables fabric pieces of different dimensions to be folded by the same machine with the need for only simple adjustments. Moreover the described machine enables different types of fold to be produced. Such machines are also of simple structure and regular operation.

What is claimed is:

1. A machine for folding a fabric, comprising:

a structure (1) with a slide surface (31,32) for the fabric;

a multiple-belt conveyor (12) connected to said structure for feeding, halting and further feeding the fabric in a fabric feed direction ($F_A$), said conveyor having a plurality of belts with interspace therebetween;

suction apertures in said slide surface structure for retaining the fabric during folding operations;

two longitudinal plates (33) each hinged to said struture for rotation on an axis which is parallel to said fabric feed direction and positioned to receive the fabric in order to effect longitudinal folding of the fabric;

means connected to said longitudinal plate for rotating said longitudinal plates about said axis;

two comb-like blades (51, 53) mounted to said structure by hinges (52,55) having axes which are perpendicular to said fabric feed direction, said comb-like blades being turnable in opposite directions in order to effect transverse folding by acting in the interspaces between the conveyor belts;

means connected to said comb-like blades for turning said comb-like blades in opposite directions;

mounting means connected between at least one of said two comb-like blades (53) and said structures for displacement of said at least one comb-like blade into at least two positions in said feed direction to adjust for the length of the fabric to be folded in the feed direction;

suction means (318,320) connected to said structure and positioned to act along the hinges (52,55) of said comb-like blades to retain the fabric against said hinges; and halting and positioning means (118) connected to said conveyor for halting said conveyor to stop the fabric at a selected position on said slide surfaces, said longitudinal blades and said comb-like blades.

2. A machine according to claim 1, wherein the slide surface is disposed between the hinge of the other of said comb-like blades and the closest position of the hinge of the displaceable comb-like blade.

3. A machine according to claim 1, including a carriage (59) mounted to said structure for movement in the feed direction and carrying said at least one comb-like blade which is mounted for displacement, at least part of said suction means being carried by said carriage for providing suction adjacent the hinge of said at least one comb-like blade.

4. A machine according to claim 3, wherein further including at least one fluid drive system for moving said carriage to at least two positions whereat the displaceable comb-like blade is at two said positions along the machine.

5. A machine according to claim 1, including a plurality of separate suction tube members connected to said structure, each having a plurality of suction slots positioned adjacent said longitudinal blades at locations of said blades hinged to said structure, and a plurality of suction conduits each connected to one of said suction tube members, at least some of said conduits being flexible.

6. A machine according to claim 1, further including side wall portions (203) on which said longitudinal blades are mounted, and means mounting each of said side wall portions to said structure for permitting transverse relative displacement between said two longitudinal blades in a direction perpendicular to said feed direction for adjusting a position of the longitudinal folds produced by said longitudinal blades.

7. A machine according to claim 6, wherein said means mounting said side wall portions comprise guides on which said side wall portions are mounted, and drive means connected to said structure and engaged with said side wall portions for moving said side wall portions in a direction transverse to said feed direction.

8. A machine according to claim 6, wherein each of said comb-like blades comprises two parts, each part of each blade being connected to one of said side wall portions for movement with said side wall portions in a transverse direction perpendicular to said feed direction.

9. A fabric-folding machine comprising:

a fixed structure;

conveyor means for receiving a fabric to be folded, said conveyor means connected to said structure for moving the fabric in a feed direction;

two longitudinal blades;

means connected to said longitudinal blades for pivotally mounting them to said structure for pivotal movement through 180° about axes lying parallel to said feed direction;

two transverse blades;

means connected to said transverse blades for pivotally mounting them to said structure for rotation through 180° about axes extending perpendicularly to said feed direction;

said longitudinal and transverse blades having upper surfaces for receiving a fabric conveyed by said conveyor in said feed direction;

suction means connected to said structure for attracting fabric toward said longitudinal and transverse blades; and means connected between said longitudinal and transverse blades and said structure for changing a separation of said longitudinal blades in a direction transverse to said feed direction, and a separation of said transverse blades in a direction parallel to said feed direction.

* * * * *